US006880495B2

(12) United States Patent
Le Lievre et al.

(10) Patent No.: US 6,880,495 B2
(45) Date of Patent: Apr. 19, 2005

(54) METHOD AND DEVICE FOR COOLING A MOTOR VEHICLE ENGINE

(75) Inventors: Armel Le Lievre, Montesson (FR); Ludovic Tomasseli, Courbevoie (FR)

(73) Assignee: Peugeot Citroen Automobiles SA, Velizy-Villacoublay (FR)

( * ) Notice: Subject to any disclaimer, the term of this patent is extended or adjusted under 35 U.S.C. 154(b) by 102 days.

(21) Appl. No.: 10/221,153

(22) PCT Filed: Jan. 25, 2001

(86) PCT No.: PCT/FR01/00238

§ 371 (c)(1),
(2), (4) Date: Jan. 6, 2003

(87) PCT Pub. No.: WO01/69056

PCT Pub. Date: Sep. 20, 2001

(65) Prior Publication Data

US 2003/0196612 A1 Oct. 23, 2003

(30) Foreign Application Priority Data

Mar. 17, 2000 (FR) ..... 00 03436

(51) Int. Cl.[7] ..... F01P 11/18
(52) U.S. Cl. ..... 123/41.1; 123/41.13
(58) Field of Search ..... 123/41.1, 41.05, 123/41.31, 41.12

(56) References Cited

U.S. PATENT DOCUMENTS

| | | | | |
|---|---|---|---|---|
| 4,475,485 A | * | 10/1984 | Sakakibara et al. | 123/41.05 |
| 4,489,680 A | * | 12/1984 | Spokas et al. | 123/41.05 |
| 4,913,107 A | | 4/1990 | Schweiger | 123/41.54 |
| 4,930,455 A | | 6/1990 | Creed et al. | 123/41.1 |
| 5,215,044 A | | 6/1993 | Banzhaf et al. | 123/41.29 |
| 5,241,926 A | | 9/1993 | Sato et al. | 123/41.54 |
| 5,529,025 A | * | 6/1996 | Ranzinger et al. | 123/41.1 |
| 5,758,607 A | | 6/1998 | Brendel et al. | 123/41.1 |
| 5,799,625 A | * | 9/1998 | Ziolek et al. | 123/41.1 |

(Continued)

FOREIGN PATENT DOCUMENTS

| | | |
|---|---|---|
| DE | 40 33 261 A1 | 4/1992 |
| DE | 41 09 498 A1 | 9/1992 |
| DE | 199 48 160 A1 | 4/2001 |
| EP | 0 499 071 A1 | 8/1992 |
| EP | 0557 113 A2 | 8/1993 |
| EP | 0 893 581 A2 | 1/1999 |
| FR | 2 722 244 | 1/1996 |
| FR | 2 776 707 | 10/1999 |

OTHER PUBLICATIONS

Von Matthias Banzhaf; ATZ–Supplement, vol. 95, No. 9, pp. 4–6, Sep. 1993. See PCT search report.
EPO—Patent Abstract of Japan, Publication No. 59119010, dated Jul. 10, 1984.
V. M. Banzhaf; ATZ Automobiltechnische Zeitschrift & Supplement, vol. 95, No. 9, pp. 4–6, Sep. 1, 1993.

*Primary Examiner*—Henry C. Yuen
*Assistant Examiner*—Jason Benton
(74) *Attorney, Agent, or Firm*—Westerman, Hattori Daniels & Adrian LLP

(57) ABSTRACT

A method for cooling a motor vehicle engine consists in regulating the volume and the flow rate of a coolant fluid in a hydraulic circuit provided with a branch equipped with an electronically controlled actuator and means forming radiator. The method comprises a step of determining the temperature of the cooling liquid, a step of comparing the temperature of the cooling liquid with a specified threshold temperature from which the engine is said to be hot, and, when the temperature of the fluid is higher than the threshold temperature, the flow rate in the radiator branch is regulated so as to maintain the temperature of the cooling fluid around a specified setpoint value. The curve representing the opening of the thermostat valve based on the temperature of the cooling fluid exhibits an hysteresis around the setpoint temperature. The invention also concerns a device for cooling a motor vehicle engine.

36 Claims, 4 Drawing Sheets

Figure 1:
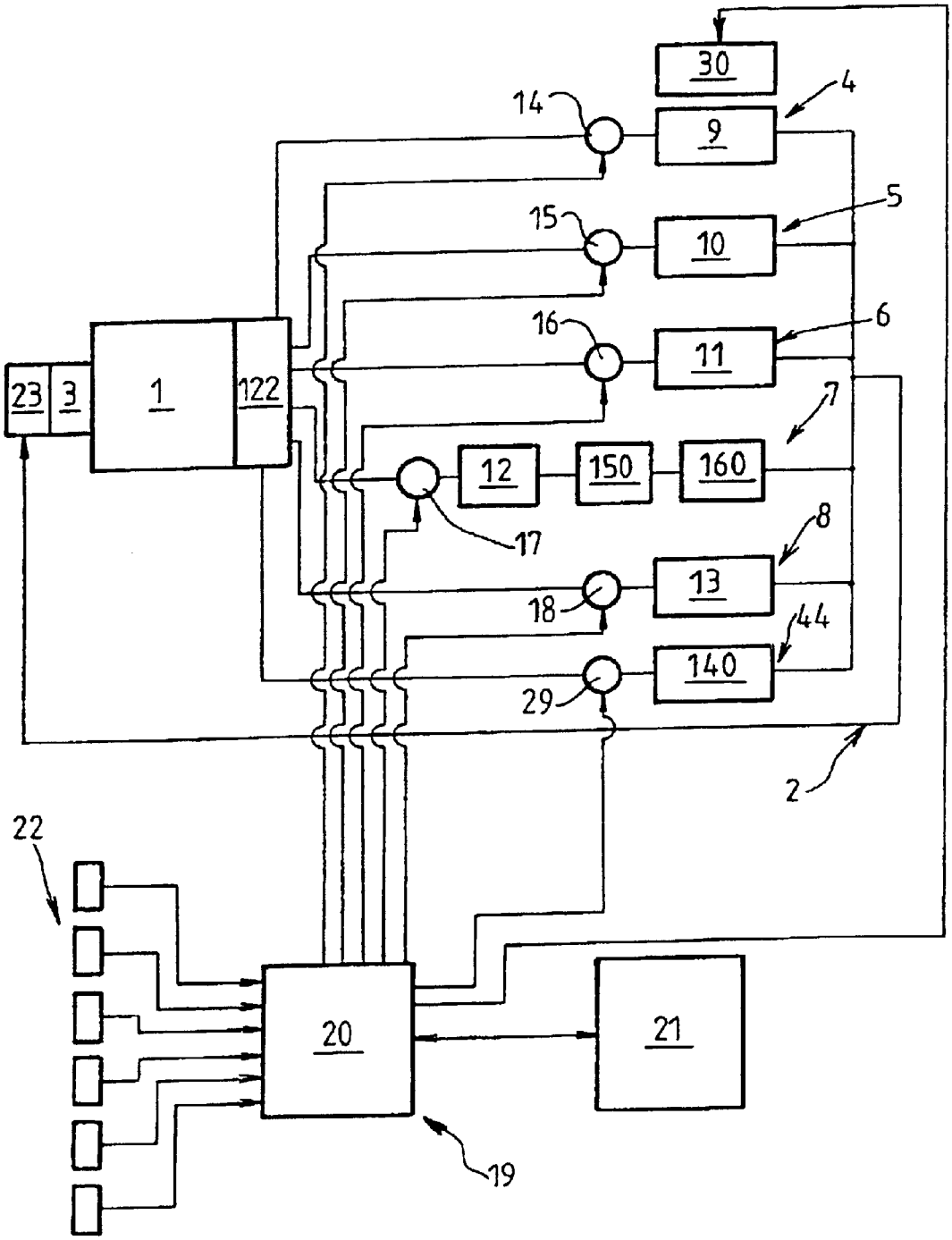

U.S. PATENT DOCUMENTS 5,836,269 A 11/1998 Schneider ..... 123/41.1
5,884,243 A * 3/1999 Taniguchi et al. ..... 702/183
5,950,576 A 9/1999 Busato et al. ..... 123/41.08
5,975,031 A * 11/1999 Bartolazzi ..... 123/41.1
6,055,947 A * 5/2000 Okuno ..... 123/41.13
6,182,617 B1 * 2/2001 Bigcharles ..... 123/41.1
6,308,664 B1 * 10/2001 Ambros ..... 123/41.12
6,314,920 B1 * 11/2001 Suzuki et al. ..... 123/41.1
6,688,262 B1 * 2/2004 Murakami et al. ..... 123/41.1
6,705,586 B1 * 3/2004 Williges ..... 251/129.04
6,739,290 B1 * 5/2004 Iwasaki et al. ..... 123/41.05

* cited by examiner

METHOD AND DEVICE FOR COOLING A MOTOR VEHICLE ENGINE

The invention concerns a method and a device for cooling a motor vehicle engine.

The invention concerns more particularly a cooling device comprising a hydraulic circuit of a cooling fluid, associated with a pump for circulating the cooling fluid through the engine of the vehicle and different branches of the circuit. Thermal equipment of the vehicle can be disposed in the different branches of the circuit.

Cooling systems are designed to ensure the resistance of engines to the thermo-mechanical stresses resulting from combustion. In addition, complementary functions are implemented, beyond the main cooling of the engine, in order to improve the overall efficiency or to provide and guarantee benefits to vehicle users, such as, for example, the heating of the passenger compartment.

The cooling systems are dimensioned using only operation points at maximum speed and full charge of the engine, and are thus over-dimensioned in the majority of usage cases of the vehicles.

Thus, the operation parameters of the engine are not optimized, which leads to a degradation of its performances, such as increased consumption, a high level of emission of pollutants, as well as a reduction in the heating and acoustic comfort of the vehicle.

Document EP557113 describes an engine cooling system comprising a cooling liquid loop connected to a radiator, and means for regulating the flow rate of the liquid in this loop. The means for regulating the flow rate are dependent on operation conditions of the vehicle, in particular by means of sensors of the temperature of the liquid disposed in different locations in the loop. The flow rate of the cooling liquid in the radiator loop is controlled in particular in order to regulate the temperatures of the liquid at the outlet and at the inlet of the engine around respective setpoint values.

However, this system has a complex structure and uses a large number of measured state variables, without optimizing thermal exchanges with the cooling liquid.

A purpose of the present invention is to propose a method for cooling a motor vehicle engine, correcting all or a part of the disadvantages of the prior art mentioned above.

This purpose is achieved in that the method for cooling a motor vehicle engine consists in regulating the volume and the flow rate of a cooling liquid in a hydraulic circuit provided with a branch equipped with an electronically controlled actuator and provided with means forming radiator, the method comprising a first step of determining the temperature of the cooling fluid, a step of comparing this temperature with a specified threshold temperature from which the engine is said to be "hot", and, when the temperature of the fluid is higher than the threshold temperature, the flow rate in the radiator branch is regulated so as to maintain the temperature of the cooling liquid around a specified setpoint value, characterized in that the curve representative of the opening of the thermostatic valve in function of the temperature of the cooling fluid exhibits an hysteresis around the setpoint value, so as to regulate the temperature of the cooling liquid at said setpoint value.

Another purpose of the present invention is to propose a cooling device for a motor vehicle engine, correcting all or a part of the disadvantages of the prior art mentioned above.

This purpose is achieved in that the cooling device for a motor vehicle engine is of the type comprising a hydraulic circuit of a cooling fluid, associated with a pump for circulating the fluid through the engine of the vehicle and different branches of the circuit, in which are arranged thermal equipment of the vehicle, at least some of the branches of the circuit being equipped with electronically controlled actuators to regulate the circulation of the fluid in these branches, the device comprising means for collecting information relating to the operation conditions of the vehicle, connected to means for controlling the operation of the actuators, in order to regulate the volume and the flow rate of fluid circulating in the hydraulic circuit so as to optimize the operation of the engine, the circuit comprising a branch equipped with an electronically controlled actuator and provided with means forming radiator, the means for collecting information being adapted to determine the temperature of the cooling fluid, so that, when the temperature of the fluid is higher than a specified threshold value from which the engine is referred to as "hot", the control means regulate the flow rate in the radiator branch so as to maintain the temperature of the cooling liquid around a specified setpoint value, characterized in that the actuator of the radiator branch is constituted by a thermostatic valve adapted to be electronically controlled, and in that the curve representative of the opening of the thermostatic valve as a function of the temperature of the cooling fluid has hysteresis around the setpoint temperature, so as to regulate the temperature of the cooling liquid at said setpoint temperature.

Further, the invention can comprise one or several of the following characteristics:

- the setpoint temperature is between 60 and 120 degrees approximately,
- the control means cooperate with the information collecting means to determine the temperature of the intake air of the engine, so as to increase the flow rate in said branch when the temperature of the intake air of the engine increases beyond a specified first threshold,
- the control means increase the flow rate in the radiator branch when the temperature of the intake air of the engine increases, so as to ensure a maximum flow rate in the branch when the temperature of the intake air of the engine reaches a specified second threshold,
- the control means cooperate with the information collecting means, in order to determine the speed of the vehicle, so as to increase the flow rate in said branch when the speed of the vehicle increases beyond a specified first threshold,
- the control means increase the flow rate in the radiator branch when the speed of the vehicle increases, so as to ensure a maximum flow rate in the branch when the speed of the vehicle reaches a specified second threshold,
- the device comprises ventilation means, or "Motor Ventilation Group", adapted to cooperate with the means forming radiator, the control means ensuring the control of the ventilation means as a function of the temperature of the cooling liquid, so that the rotational speed of the ventilation means increases when the temperature of the cooling fluid increases,
- the increase in the rotational speed of the ventilation means is controlled as a function of the speed of variation of the temperature of the cooling liquid, the rotational speed of the ventilation means as a function of the temperature of the cooling liquid follows a line whose slope is proportional to the speed of variation of the temperature of the cooling liquid,
- the ventilation means are started when the temperature of the cooling liquid is higher than the setpoint value and the flow rate of the cooling liquid in the radiator branch is substantially maximum, the control means cooperate with the information collecting means to determine the temperature of the air located under the vehicle hood, so as to start the ventilation means when the temperature of the air located under the hood is higher than a specified threshold.

Figure 2:
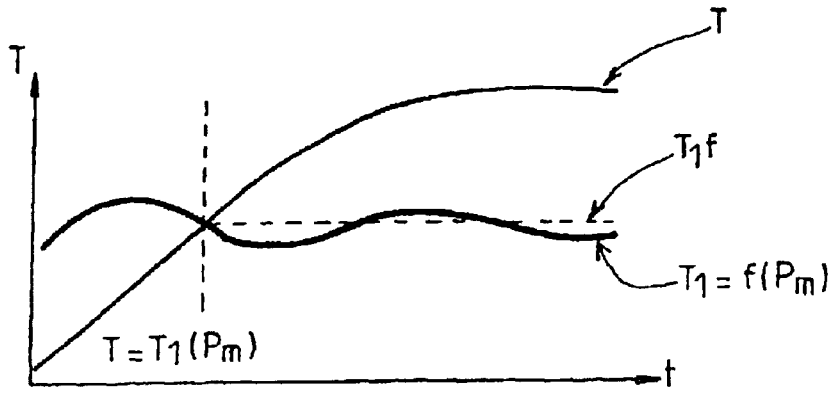
Figure 6:
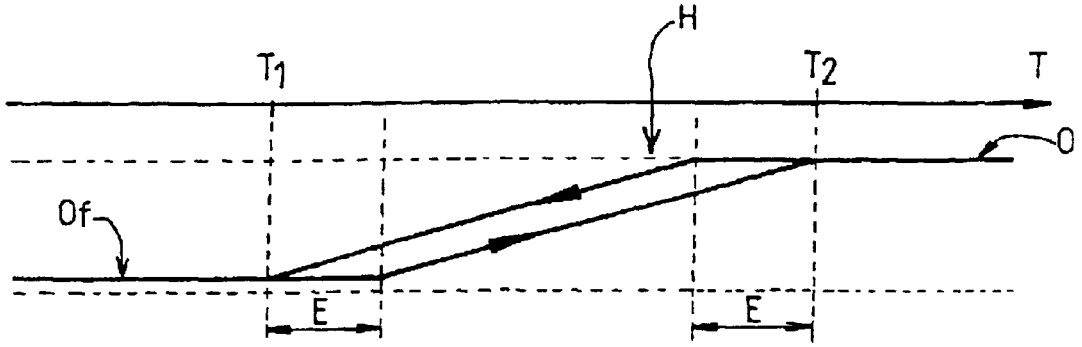
Figure 3:
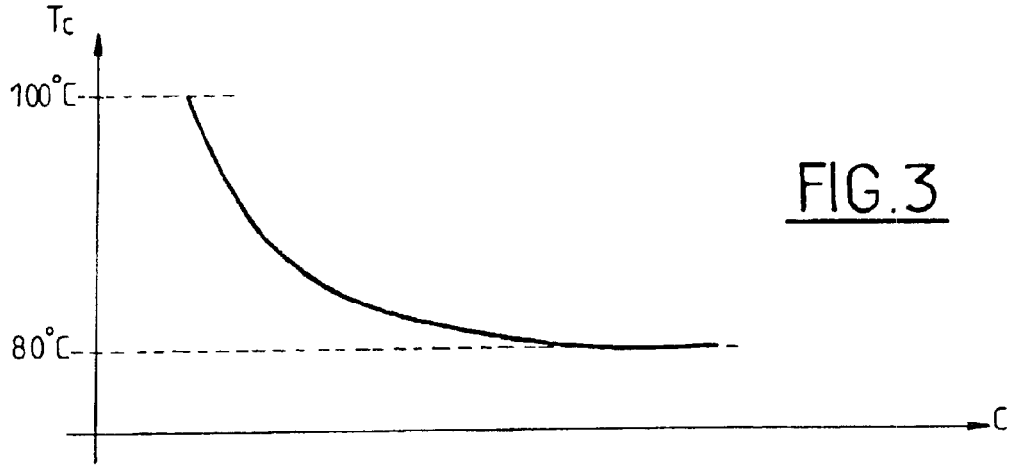
Figure 4:
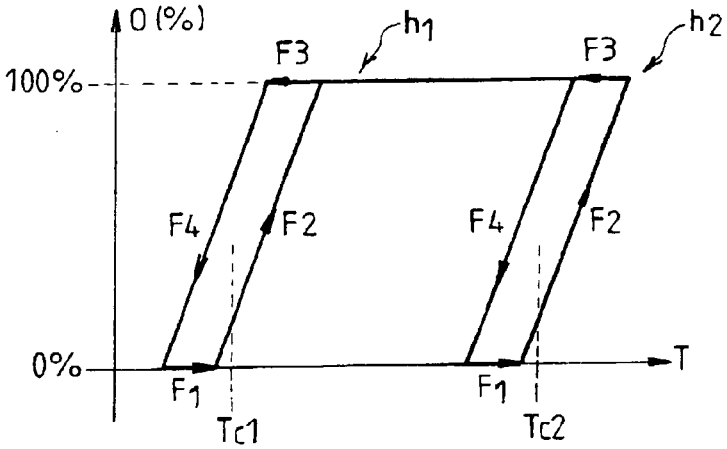
Figure 5:
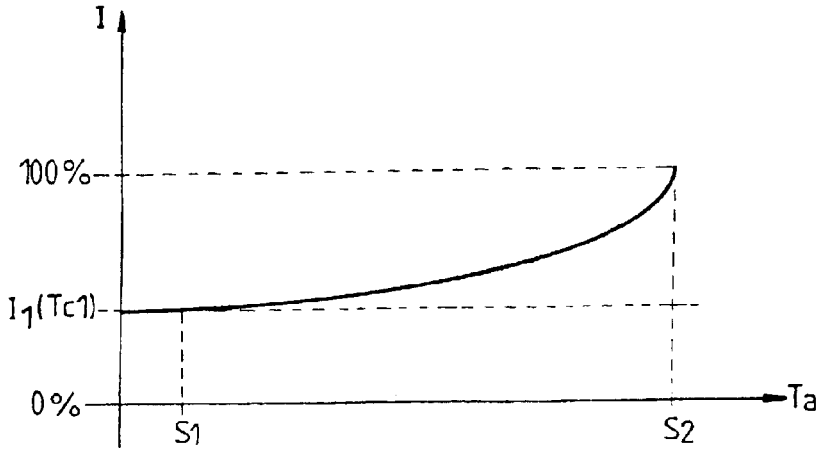
Figure 7:
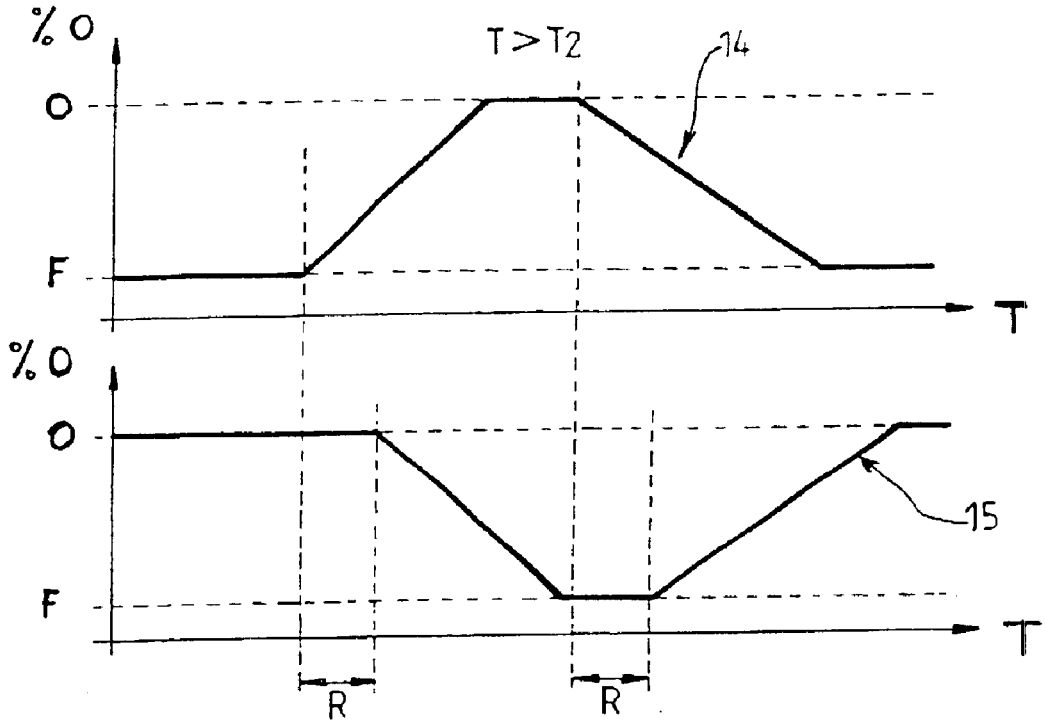
Figure 8:
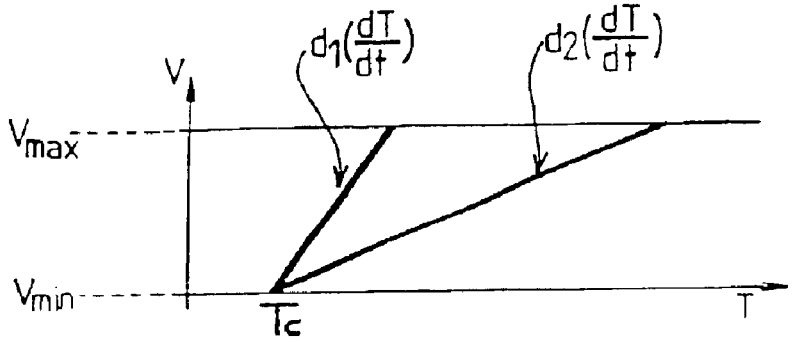

Other characteristics and advantages will appear in reading the following description, made in reference to the drawings in which:

FIG. 1 shows schematically the structure and the operation of an example of embodiment of the cooling device according to the present invention, FIG. 2 shows, on a same graph, an example of variation in the course of time t of the temperature T of the cooling liquid and of a first threshold temperature $T_1$, FIG. 3 shows the variation of a setpoint temperature Tc as a function of the torque C of the vehicle engine, the engine speed being constant, FIG. 4 shows the variation of the percentage of opening of the radiator valve as a function of the temperature T of the cooling fluid, FIG. 5 shows an example of variation of the electric pulse I to control the radiator valve as a function of the temperature of the intake air Ta of the engine, torque, engine speed, and vehicle speed being constant, FIG. 6 shows the opening state of a bypass valve as a function of the temperature T of the cooling liquid, FIG. 7 shows schematically an example of coupling of the opening of the bypass valve as a function of the opening of the radiator valve, FIG. 8 shows two examples of variation of the rotational speed of a motor ventilation group as a function of the variation of the temperature T of the cooling liquid.

FIG. 1 shows a preferred example of embodiment of a cooling device according to the invention. The cooling device comprises a hydraulic circuit 2 containing a cooling fluid.

A hydraulic pump 3 is associated with the circuit 2 in order to ensure the circulation of the fluid through the engine 1 and different branches 4, 5, 6, 7, 8, 44 of the circuit 2. Preferably, the pump 3 is a pump of the mechanical type, however, the use of an electric pump can also be envisioned.

The branches 4, 5, 6, 7, 8, 44 of the circuit 2 are supplied with cooling liquid from a box 122, or "Water Outlet Box" (WOB). The box 122, which is affixed to the engine 1, and preferably to the engine block 1, ensures the collection of the cooling liquid having circulated in the engine 1. The cooling liquid that has circulated in the branches is itself recovered by a water input collector 23 before its recirculation in the engine 1.

Advantageously, at least some of the branches 4, 5, 6, 7, 8, 44 of the circuit 2 are equipped with respective electronically controlled actuators 14, 15, 16, 17, 18, 29 for regulating the circulation of the fluid in these branches. The electronically controlled actuators are, for example, solenoid valves. In addition, the device comprises means 22 for collecting information relating to the operation conditions of the vehicle. The collection means 22 are connected to the means 19 for controlling the operation of at least one part of the actuators 14, 15, 16, 17, 18, 29, in order to regulate the volume and the flow rate of the fluid circulating in the hydraulic circuit 2 so as to optimize the operation of the engine.

The control means 19 or information processing unit can comprise any appropriate computer 20 such as, for example, an "Intelligent Coupling Box" (ICB) of a known type. The computer 20 is associated with means 21 for storing information comprising, for example, a programmable memory and/or a read-only memory. The computer 20 is also connected to means 22 for collecting information relating to the operation conditions of the vehicle, comprising, for example, various sensors or other computers such as an engine control computer.

Preferably, the information collection means 22 are adapted to determine at least one of the following parameters: the speed of the engine, the torque of the engine, the speed of the vehicle, the temperature of the engine lubrication oil, the temperature of the cooling liquid of the engine, the temperature of the exhaust gases of the engine, the temperature of the air outside the vehicle and the temperature inside the passenger compartment. The various items of information relating to the operation conditions of the vehicle are processed and analyzed by the computer 20, in order to control the operation of the actuators 14, 15, 16, 17, 18, 29, and possibly, the operation of the pump 3.

According to the invention, the flow rate or the volume of cooling liquid allowed or not allowed to circulate in the different branches 4, 5, 6, 7, 8, 44 of the circuit 2 is a function of the heated state of the engine 1. For example, it is possible to define three states of the engine 1, a first state in which the engine is referred to as "cold", a second in which the engine 1 is referred to as "hot" and a third state referred to as "intermediate" between the hot and cold states.

Preferably, the thermal state of the engine 1 is characterized as a function of the temperature T of the cooling liquid, preferably at the outlet of the engine 1. Thus, when the temperature of the cooling liquid is lower than a specified first threshold temperature $T_1$, the state of the engine 1 is referred to as cold. Similarly, when the temperature T of the cooling liquid is higher than a specified second threshold temperature $T_2$, the state of the engine 1 is referred to as hot. Finally, when the temperature of the cooling liquid is between the first threshold temperature $T_1$ and the second threshold temperature $T_2$, the state of the engine 1 is referred to as intermediate.

The first threshold temperature $T_1$, and/or the second threshold temperature $T_2$ can be fixed or variable values specified as a function of the type of the engine 1. Preferably, the first threshold temperature $T_1$, and/or the second threshold temperature $T_2$ are variables as a function of the type of engine 1 and of at least one operation parameter of the engine 1. For example, the first threshold temperature $T_1$, and/or the second threshold temperature $T_2$ are functions of the average power Pm supplied by the engine 1. In other words, the control means 19 cooperate with the collection means 22 in order to calculate the average instantaneous power Pm supplied by the engine 1.

The control means 19 then calculate the first threshold temperature $T_1$, and/or the second threshold temperature $T_2$, as a function of the average instantaneous power Pm and of a specified modeling of the operation of the engine 1. The modeling of the engine defines the cold, hot and intermediate states (first threshold temperature $T_1$ and second threshold temperature $T_2$) as a function of the average power Pm supplied by the engine.

The instantaneous power P(t) in kilowatts (kW) supplied by the engine at the time t is given by the following equation:

$$P(t) = \frac{2 \cdot \pi \cdot N \cdot C}{60 \times 1000},$$

where N is the instantaneous speed of the engine in rpm, and C is the instantaneous torque of the engine in N.m. The values of the speed N and the torque C can be measured by the information collection means 22, i.e., by appropriate sensors. Traditionally, the speed N of the engine is between 0 and 6000 rpm approximately, while the torque C is between 0 and 350 N.m approximately.

The control means 19 then calculate the power P(t) supplied by the engine at the time t and the average power Pm(t) supplied by the engine at the time t. The average power Pm(t) at time t can be calculated by the following equation:

$$Pm(t) = \frac{(t-1) \times Pm(t-1) + Pm(t)}{t},$$

where Pm(t−1) is the average power at the time (t−1). Of course, the average power can be calculated by any other equivalent formula, such as:

$$Pm(t) = \frac{c \cdot Pm(t-1) + kP(t)}{c+k},$$

where Pm(t−1) is the average power at the time (t−1), P(t) is the instantaneous power at the time t, and c and k are weighting coefficients.

The computer 19 and/or the information storage means 21 can contain the modeling of the operation of the engine 1, defining its cold state, hot state, and intermediate state (first threshold temperature $T_1$ and second threshold temperature $T_2$) as a function of the average power Pm. In other words, for a given type of engine, correspondence tables are created empirically and/or by calculation, giving the threshold temperatures $T_1$ and $T_2$ as a function of the average power Pm of the engine 1. These tables or models, which are a function of the type of engine, are, for example, polynomial functions. The first threshold temperature $T_1$ is thus, in general, a decreasing function of the average power.

The first threshold temperature $T_1$ can vary between 20 and 60 degrees approximately, and preferably between 30 and 50 degrees. The second threshold temperature $T_2$ can itself vary between 60 and 100 degrees approximately. However, the threshold temperature $T_2$ is generally substantially constant around the value of 80 degrees.

Thus, the control means 19 cooperate with the information collection means 22 in order to compare the temperature T of the cooling liquid with the two threshold temperatures $T_1$ and $T_2$.

For purposes of simplification, the value of the first threshold temperature $T_1$, can be fixed by the control means 19 as soon as the measured temperature T of the cooling liquid reaches the first threshold temperature $T_1$. Thus, FIG. 3 illustrates, in a same graph, an example of variation in the course of the time t: of the temperature T of the cooling liquid, and of the first threshold temperature $T_1$(Pm) which is a function of the average power. In determining these temperatures T and $T_1$(Pm), it is noted that, for a given average power, from the time when the temperature T of the fluid reaches the first threshold value T1, this first threshold temperature $T_1$, varies slightly around a constant $T_1$f.

Referring to FIG. 1, the circuit comprises a branch 4 equipped with an electronically controlled actuator 14 and provided with means 9 forming radiator. The radiator means 9 can be coupled to a motor ventilation group 30, which can also be controlled by control means 19.

According to the invention, the information collecting means 22 determine the temperature T of the cooling fluid, so that, when it is higher than the second threshold temperature $T_2$, the control means 19 regulate the flow rate in the radiator branch 4 so as to maintain the temperature T of the cooling liquid around a specified setpoint value Tc.

The setpoint temperature Tc is the temperature of the cooling liquid that ensures an optimal operation of the engine 1. This setpoint temperature Tc is defined, for example, by a modeling of the concerned engine. The setpoint temperature Tc is, for example, between 60 and 120 degrees approximately, and preferably between 80 and 100 degrees approximately.

Preferably, the control means 19 cooperate with the information collecting means 22 in order to determine the setpoint temperature Tc as a function of the speed N and/or of the torque C of the engine 1.

Preferably, the setpoint temperature Tc is decreasing when the torque C of the engine 1 increases. Similarly, the setpoint temperature Tc decreases when the speed N of the engine 1 increases.

FIG. 3 illustrates an example of a curve representative of the variation of the setpoint temperature Tc as a function of the torque C of the engine, the engine speed N being constant. The setpoint temperature Tc follows substantially a portion of a curve of the type $Tc=A1+(A2/C^n)$, where Tc is the setpoint temperature, A1 and A2 are constants, C is the torque, and n is an integer superior or equal to one. More precisely, for a engine speed N in the maximum Nmax order, when the torque C is under or equal to half the maximum torque, the setpoint temperature Tc is substantially equal to 100 degrees. Further, when the torque C goes toward the maximum torque, the setpoint temperature Tc goes toward 80 degrees approximately.

Similarly, the curve representative of the variation of the setpoint temperature Tc as a function of the torque C, the engine speed N being constant, can have a general shape comparable to the curve of FIG. 3.

The actuator 14 of the radiator branch 4 can be constituted by a thermostatic valve adapted to be electronically controlled. Traditionally, the valve 14 can contain a part adapted to dilate or retract, in order to regulate the degree of opening of the valve as a function of its temperature. In addition, the part adapted to dilate can also be heated electrically in order to control in real time the opening and the closing of the valve.

FIG. 4 shows two examples of variation of the percentage of opening %O of the thermostatic valve 14 of the radiator as a function of the temperature T of the cooling fluid.

More precisely, FIG. 4 illustrates two examples of regulation of the temperature T of the cooling fluid around two distinct setpoint temperatures respectively Tc1, Tc2. Thus, the curve of opening O of the thermostatic valve 14 exhibits a first hysteresis h1 around the first setpoint temperature Tc1 and a second hysteresis h2 around the second setpoint temperature Tc2. The succession of the closing F1, progressive opening F2, opening F3 and progressive closing F4 phases of the valve 14 is symbolized by arrows.

The first setpoint temperature Tc1 can correspond, for example, to a phase of strong solicitation of the engine, whereas the second setpoint temperature Tc2, which is higher, can correspond to a lower solicitation of the engine.

Of course, the invention is not limited to the preferred embodiment described above. Thus, the actuator 14 of the radiator branch 4 can be constituted by an electronically controlled proportional valve.

In this case, when the temperature T of the cooling fluid is higher than the setpoint temperature Tc by a specified difference dT in the order, for example, of 3 degrees, the control means 19 can increase the opening of the proportional valve 14. Similarly, when the temperature T of the cooling fluid becomes lower than the setpoint temperature Tc by a specified difference dT in the order, for example, of 3 degrees, the control means 19 can reduce the opening of the proportional valve 14.

Advantageously, the control means 19 can cooperate with the information collecting means 22, in order to determine the temperature Ta of the intake air of the engine 1 and to increase the flow rate of the cooling fluid in the radiator branch 4 when the temperature Ta of the intake air of the engine 1 increases beyond a specified first threshold S1.

Further, the control means 19 can ensure a maximum flow rate in the radiator branch 4 when the temperature Ta of the intake air of the engine 1 reaches a specified second threshold S2. The first temperature threshold S1 and second temperature threshold S2 for the intake air can be in the order of 40 and 60 degrees, respectively.

FIG. 5 shows an example of variation of the electric pulse or intensity I for controlling the radiator valve 14, as a function of the temperature Ta of the intake air of the engine, the engine speed N, torque C, and vehicle speed being constant.

Referring to FIG. 5, 11 corresponds to the electric impulsion provided to the actuator 14 (proportional electrovalve or thermovalve) for a given setpoint temperature Tc1. This electric pulse 11, which is between 0 and 100% of the maximum pulse, defines a specified partial opening of the actuator 14. When the temperature Ta of the intake air goes toward the first threshold S1, the electric pulse I provided to the actuator 14 goes toward I1.

When the temperature Ta of the intake air goes toward the second threshold S2, the electric pulse I provided to the actuator 14 increases and goes toward the maximum pulse (100%), i.e., toward a total opening of the valve 14. This means that, for a given increase in the setpoint temperature Tc defining a given flow rate in the radiator branch 4, the increase in the intake temperature Ta can generate a flow rate increase, even when the setpoint temperature Tc does not vary.

Similarly, the control means 19 can cooperate with the information collecting means 22 in order to determine the speed of the vehicle, so as to increase the flow rate in that branch 4 when the speed of the vehicle increases beyond a specified first threshold.

Similarly, the control means 19 can ensure a maximum flow rate in the radiator branch 4 when the speed of the vehicle reaches a specified second threshold.

The curve of variation of the electric pulse or intensity I for controlling the radiator valve 14 as a function of the speed of the vehicle can have a general shape similar to the curve in FIG. 5.

The first and second vehicle speed thresholds can be in the order of, respectively, half the maximum legal speed and the maximum speed.

As illustrated in FIG. 1, the circuit 2 comprises another branch 5 equipped with an electronically controlled actuator 15 and associated with means 10 forming direct return of fluid or bypass. The control means 19 can regulate the circulation of the cooling fluid in the bypass branch 5 as a function of the temperature T of this fluid. In particular, the quantity of fluid allowed to circulate in the bypass branch 5 increases when the temperature of the fluid increases from the first threshold temperature $T_1$, toward the second threshold temperature $T_2$. Preferably, the electronically controlled actuator 15 of the bypass branch 5 is of the proportional type.

As shown in FIG. 6, when the temperature of the fluid T is lower than the first threshold temperature $T_1$, the control means 19 can limit the circulation of the fluid in the bypass branch 5 to a specified leakage rate. In other words, the actuator 15 of the bypass branch 5 is partially open Of. For example, the partial opening Of of the actuator 15 can ensure a leakage rate in the bypass branch 5 of between 1/50 and 1/5 approximately of the maximum flow of the branch 5.

When the temperature of the fluid is higher than the second threshold temperature $T_2$, the control means 19 command at least temporarily the total opening O of the bypass actuator 15 (FIG. 6). In addition, when the temperature of the fluid is between the first threshold temperature $T_1$ and the second threshold temperature $T_2$, the degree of opening of the actuator 15 can be at least temporarily proportional to the temperature T of the cooling fluid. More precisely, between $T_1$ and $T_2$, the opening of the actuator 15 of the bypass increases when the temperature T of the fluid increases, and decreases when the temperature T of the fluid decreases. The variation of the opening of the actuator 15 can be proportional to the temperature T of the fluid.

Advantageously, the curve that is representative of the opening of the actuator 15 as a function of the temperature T of the fluid can exhibit an hysteresis H. In other words, the increase in the opening of the actuator 15 begins after the temperature of the liquid T exceeds the first reference temperature $T_1$, by a specified first value E. Similarly, the reduction in the opening of the actuator 15 begins after the temperature T of the liquid becomes lower, by a specified first value E, than the second reference temperature $T_2$. In other words, openings and closings of the actuator 15 are done in a manner offset relative to the threshold temperatures $T_1$ and $T_2$. The values E of these offsets are, for example, in the order of 5 degrees.

Advantageously, when the temperature T of the fluid is higher than the second threshold temperature $T_2$, the control means 19 can command the actuator 15 of the bypass branch 5 as a function of the opening and closing of the actuator 14 of the radiator branch 4.

FIG. 7 illustrates the percentage of opening %O of the actuators 15, 14 of the bypass branch 5 and radiator branch 4 as a function of the temperature T of the cooling liquid. As shown in FIG. 7, the control means 19 can close F the actuator 15 of the bypass branch 5 when the actuator 14 of the radiator branch 4 is opened O. Similarly, the actuator 15 of the bypass branch 5 is opened O when the actuator 14 of the radiator branch 4 is closed F. Preferably, the opening of the actuator 15 of the bypass branch 5 is inversely proportional to the opening of the actuator 14 of the radiator branch 4.

Further, the closings and openings of the actuator 15 of the bypass branch 5 can be performed with a specified temperature offset R relative to the openings and closings of the actuator 14 of the radiator branch 4. The temperature offset R can be in the order of a several degrees, for example, five degrees.

As shown in FIG. 8, the control means 19 can control the ventilation means 30 as a function of the temperature of the cooling liquid. More precisely, the rotational speed of the ventilation means 40 can increase when the temperature T of the cooling liquid increases.

Preferably, the rotational speed V of the ventilating means 30 increases proportionally to the speed of variation of the temperature of the cooling liquid $$\frac{dT}{dt}.$$

FIG. 8 shows two examples of lines d1 and d2 representing the rotational speed of the motor ventilation unit as a function of the temperature T of the liquid. The two lines d1 and d2 have different slopes each representing a speed of variation $$\frac{dT}{dt}$$

of the temperature T of the cooling liquid. The speed of variation $$\frac{dT}{dt}$$

of the temperature T of the cooling liquid can be calculated by the control means 19.

Preferably, the ventilation means 30 are started when the temperature T of the cooling fluid is higher than the setpoint temperature Tc and the flow rate of the cooling liquid in the radiator branch is substantially maximum.

Similarly, the control means 19 can cooperate with the information collecting means 22 in order to determine the temperature of the air located under the vehicle hood, so as to start the ventilation means 40 when the temperature of the air located under the hood is higher than a specified threshold.

Advantageously, the information collecting means 22 can be adapted to detect a possible malfunction of at least one of the electronically controlled actuators. In this manner, when at least one failure of an actuator is detected and regardless of the temperature of the fluid, the control means 19 can ensure free circulation of the fluid in at least some of the branches, and preferably in all of the branches. In other words, when a malfunction of the system is detected, all of the valves of circuit 2 are opened.

Thus, it is easy to understand that the cooling device according to the invention, while having a simple structure, makes it possible to manage heat exchanges in real time and in an optimum manner.

Finally, though the invention has been described in connection with specific embodiments, it comprises all technical equivalents of the means described.

What is claimed is:

1. Method for cooling a motor vehicle engine, consisting in regulating the volume and the flow rate of a cooling fluid in a hydraulic circuit provided with a branch equipped with an electronically controlled actuator and provided with means forming radiator, the method comprising:

a first step of determining the temperature (T) of the cooling fluid, a step of comparing this temperature with a specified threshold temperature ($T_2$) from which the engine is referred to as "hot", and when the temperature (T) of the fluid is higher than the threshold temperature ($T_2$), regulating the flow rate in the radiator branch so as to maintain the temperature (T) of the cooling liquid around a specified setpoint value (Tc), wherein the curve representative of the opening (O) of the thermostatic valve as a function of the temperature (T) of the cooling fluid exhibits an hysteresis around the setpoint temperature, so as to regulate the temperature (T) of the cooling fluid at said setpoint temperature.

2. Device for cooling a motor vehicle engine, of the type comprising a hydraulic circuit of a cooling fluid, associated with a pump for circulating this fluid through the engine of the vehicle and different branches of the circuit, in which are arranged thermal equipment of the vehicle, at least some of the branches of the circuit being equipped with electronically controlled actuators to regulate the circulation of the fluid in these branches, the device comprising:

means for collecting information relating to the operation conditions of the vehicle, connected to means for controlling the operation of the actuators, in order to regulate the volume and the flow rate of fluid circulating in the hydraulic circuit so as to optimize the operation of the engine, the circuit comprising a branch equipped with an electronically controlled actuator and provided with means forming radiator, the information collecting means being adapted to determine the temperature (T) of the cooling fluid, so that, when the temperature (T) of the fluid is higher than a specified threshold temperature ($T_2$) from which the engine is referred to as "hot", the control means regulate the flow rate in the radiator branch so as to maintain the temperature (T) of the cooling liquid around a specified setpoint value (Tc), wherein the actuator of the radiator branch is constituted by a thermostatic valve adapted to be electronically controlled, and in that the curve representative of the opening (O) of the thermostatic valve as a function of the temperature (T) of the cooling fluid exhibits an hysteresis around the setpoint temperature, so as to regulate the temperature (T) of the cooling liquid at said setpoint temperature.

3. Device according to claim 2, wherein the setpoint temperature (Tc) is between 60 and 120 degrees C. approximately.

4. Device according to claim 2, wherein the control means cooperate with the information collecting means, in order to determine the temperature (Ta) of the intake air of the engine, so as to increase the flow rate in said radiator branch when the temperature (Ta) of the intake air of the engine increases beyond a specified first threshold (S1).

5. Device according to claim 4, wherein the control means increase the flow rate in the radiator branch when the temperature (Ta) of the intake air of the engine increases, so as to ensure a maximum flow rate in the radiator branch when the temperature (Ta) of the intake air of the engine reaches a specified second threshold (S2).

6. Device according to claim 2, wherein the control means cooperate with the information collecting means, in order to determine the speed of the vehicle, so as to increase the flow rate in said radiator branch when the speed of the vehicle increases beyond a specified first threshold.

7. Device according to claim 6, wherein the control means increase the flow rate in the radiator branch when the speed of the vehicle increases, so as to ensure a maximum flow rate in the radiator branch when the speed of the vehicle reaches a specified second threshold.

8. Device according to claim 2, which comprises ventilation means adapted to cooperate with the means forming radiator, the control means ensuring a control of the ventilation means as a function of the temperature (T) of the cooling liquid, so that the rotational speed (V) of the ventilation means increases when the temperature (T) of the cooling fluid increases.

9. Device according to claim 8, wherein the increase of the rotational speed (V) of the ventilation means is controlled as a function of the speed of variation $$\left(\frac{dT}{dt}\right)$$

of the temperature (T) of the cooling liquid.

10. Device according to claim 9, wherein the rotational speed of the ventilation means as a function of the temperature (T) of the cooling liquid follows a line whose slope is proportional to the speed of variation $$\left(\frac{dT}{dt}\right)$$

of the temperature T of the cooling liquid.

11. Device according to claim 8, wherein the ventilation means are started when the temperature (T) of the cooling fluid is higher than the setpoint temperature (Tc) and the flow rate of the cooling liquid in the radiator branch is substantially maximum.

12. Device according to claim 8, wherein the control means cooperate with the information collecting means, in order to determine the temperature of the air located under the vehicle hood, so as to start the ventilation means when the temperature of the air located under the hood is higher than a specified threshold.

13. Device according to claim 3, wherein the control means cooperate with the information collecting means, in order to determine the temperature (Ta) of the intake air of the engine, so as to increase the flow rate in said radiator branch when the temperature (Ta) of the intake air of the engine increases beyond a specified first threshold (S1).

14. Device according to claim 13, wherein the control means increase the flow rate in the radiator branch when the temperature (Ta) of the intake air of the engine increases, so as to ensure a maximum flow rate in the radiator branch when the temperature (Ta) of the intake air of the engine reaches a specified second threshold (S2).

15. Device according to claim 3, wherein the control means cooperate with the information collecting means, in order to determine the speed of the vehicle, so as to increase the flow rate in said radiator branch when the speed of the vehicle increases beyond a specified first threshold.

16. Device according to claim 4, wherein the control means cooperate with the information collecting means, in order to determine the speed of the vehicle, so as to increase the flow rate in said radiator branch when the speed of the vehicle increases beyond a specified first threshold.

17. Device according to claim 5, wherein the control means cooperate with the information collecting means, in order to determine the speed of the vehicle, so as to increase the flow rate in said radiator branch when the speed of the vehicle increases beyond a specified first threshold.

18. Device according to claim 15, wherein the control means increase the flow rate in the radiator branch when the speed of the vehicle increases, so as to ensure a maximum flow rate in the radiator branch when the speed of the vehicle reaches a specified second threshold.

19. Device according to claim 16, wherein the control means increase the flow rate in the radiator branch when the speed of the vehicle increases, so as to ensure a maximum flow rate in the radiator branch when the speed of the vehicle reaches a specified second threshold.

20. Device according to claim 17, wherein the control means increase the flow rate in the radiator branch when the speed of the vehicle increases, so as to ensure a maximum flow rate in the radiator branch when the speed of the vehicle reaches a specified second threshold.

21. Device according to claim 2, wherein the threshold temperature ($T_2$) is a function of the average power Pm supplied by the engine 1.

22. Device according to claim 2, wherein the setpoint temperature (Tc) is a function of speed N and/or torque C of the engine.

23. Device according to claim 2, Wherein, when the temperature of the cooling fluid is lower than the second threshold temperature ($T_2$), the opening of an actuator of a bypass branch is at least temporarily proportional to the temperature T of the cooling fluid.

24. Device according to claim 23, wherein, when the temperature of the cooling fluid is lower than a first threshold temperature ($T_1$), the opening of the actuator of the bypass branch is limited to a specified leakage rate.

25. Device according to claim 2, wherein, when the temperature of the cooling fluid is higher than the second threshold temperature ($T_2$), an actuator of a bypass branch is totally opened at least temporarily.

26. Device according to claim 2, wherein, when the temperature of the cooling fluid is higher than the second threshold temperature ($T_2$), the opening of an actuator of a bypass branch is controlled as a function of the opening of the actuator of the radiator branch.

27. Device according to claim 26, wherein the opening of the actuator of the bypass branch is inversely proportional to the opening of the actuator of the radiator branch.

28. Device according to claim 27, wherein the closings and openings of the actuator of the bypass branch are performed with a specified temperature offset (R) relative to the closings and openings of the actuator of the radiator branch.

29. Method according to claim 1, wherein the threshold temperature ($T_2$) is a function fothe average power Pm supplied by the engine 1.

30. Method according to claim 1, wherein the setpoint temperature (Tc) is a function of speed N and/or torque C of the engine.

31. Method according to claim 1, wherein, when the temperature of the cooling fluid is lower than the second threshold temperature ($T_2$), the cooling fluid flow in a bypass branch is at least temporarily proportional to the temperature T of the cooling fluid.

32. Method according to claim 31, wherein, when the temperature of the cooling fluid is lower than a first threshold temperature ($T_1$), the cooling fluid flow in the bypass branch is limited to a specified leakage rate.

33. Method according to claim 1, wherein, when the temperature of the cooling fluid is higher than the second threshold temperature ($T_2$), the cooling fluid flow in a bypass branch is maximum at least temporarily.

34. Method according to claim 1, wherein, when the temperature of the cooling fluid is higher than the second threshold temperature ($T_2$), the cooling fluid flow in a bypass branch is controlled as a function of the cooling fluid flow in the radiator branch.

35. Method according to claim 34, wherein the cooling fluid flow in the bypass branch is inversely proportional to the cooling fluid flow in the radiator branch.

36. Method according to claim 34, wherein variations in the cooling fluid flow in the bypass branch are performed with a specified temperature offset (R) relative to the variations in the cooling fluid flow in the radiator branch.

* * * * *